US011634194B2

(12) United States Patent
Owen et al.

(10) Patent No.: US 11,634,194 B2
(45) Date of Patent: Apr. 25, 2023

(54) MOORING MATE

(71) Applicants: David R. Owen, Blaine, WA (US); David Joseph Owen, Beaumont, TX (US); Clayton Newell Owen, Custer, WA (US)

(72) Inventors: David R. Owen, Blaine, WA (US); David Joseph Owen, Beaumont, TX (US); Clayton Newell Owen, Custer, WA (US)

(73) Assignee: David R. Owen, Blaine, WA (US)

( * ) Notice: Subject to any disclaimer, the term of this patent is extended or adjusted under 35 U.S.C. 154(b) by 33 days.

(21) Appl. No.: 17/448,142

(22) Filed: Sep. 20, 2021

(65) Prior Publication Data

US 2022/0089253 A1 Mar. 24, 2022

Related U.S. Application Data

(60) Provisional application No. 63/081,787, filed on Sep. 22, 2020.

(51) Int. Cl.

| | |
|---|---|
| ***B63B 21/08*** | (2006.01) |
| ***B63B 21/04*** | (2006.01) |
| ***B63B 21/06*** | (2006.01) |

(52) U.S. Cl.
CPC ..... *B63B 21/08* (2013.01); *B63B 21/045* (2013.01); *B63B 21/06* (2013.01)

(58) Field of Classification Search
CPC ..... B63B 21/04; B63B 21/045; B63B 21/06; B63B 21/08
USPC ..... 114/218, 230.29
See application file for complete search history.

(56) References Cited

U.S. PATENT DOCUMENTS 4,109,603 A * 8/1978 Guthmann ..... B63B 21/00 114/230.29
4,190,011 A * 2/1980 Guthmann ..... B63B 21/04 114/230.29

* cited by examiner

*Primary Examiner* — Daniel V Venne
(74) *Attorney, Agent, or Firm* — FisherBroyles, LLP; Jason M. Pass; Charles Hagadorn, III

(57) ABSTRACT

An apparatus for mooring a boat may include a mount body including a plurality of sidewalls forming a channel. A cleat may extend from a first of the plurality of sidewalls. A plate may be removably coupled to the mount body. The apparatus may include a clamping structure comprising a movable jaw coupled to a second of the plurality of sidewalls and configured to clamp the mount to a dock rail.

20 Claims, 8 Drawing Sheets

MOORING MATE

RELATED APPLICATIONS

This application claims the benefit under 35 U.S.C. § 119(e) of U.S. Provisional Patent Application No. 63/081,787, filed Sep. 22, 2020, and titled "Mooring Mate," which is incorporated, in its entirety, by this reference.

BACKGROUND

Prior methods and apparatus for tying boats to docks for mooring can be less than ideal in at least some respects. Some boat docks have tiedown rails for mooring a boat. Tiedown rails are long spans of rail such as a 4×4 wood rail that is supported by the mounting blocks along the perimeter of the dock. Such mooring rails are less than ideal in at least some instances. Boats may be tied to the rail using ropes. However, wind, waves, and the rocking of boats may cause the ropes to slip along the span of the rail which may lead to movement of the moored boat and potential collisions with other boats tied to the dock. In addition, tying and untying the boat over multiple days at multiple ship locations (bow, stern, and midship, for example) by wrapping the rope around the wood rails becomes very time consuming.

Some boat docks have fixed cleats that are permanently attached to the dock at fixed locations along the perimeter of the dock. Such fixed cleat locations are less than ideal in at least some instances. For example, fixed cleats may be attached at locations that are less than ideal for optimizing the number of boats attached to a dock. Also, due in part to the fixed locations, cleat placement may be less than optimal for tying off the bow and stern of different sized boats. For example, cleats located 15 feet apart from each other may be suitable for tying off boats approximately 15, 30, and 45 feet in length but less than optimal for tying of boats of 22, 37, and 50 feet.

In light of the above, improved systems, methods and apparatus for improved boat mooring would be beneficial.

SUMMARY

In some embodiments, an apparatus for mooring a boat may include a mount body including a plurality of sidewalls forming a channel. A cleat may extend from a first of the plurality of sidewalls. A plate may be removably coupled to the mount body. A clamping structure may include a movable jaw coupled to a second of the plurality of sidewalls.

In some embodiments, the clamping structure may also include a fixed jaw formed of a third sidewall. In some embodiments, the movable jaw may be movably coupled to the second of the plurality of sidewalls and may be configured to apply clamping forces to a dock rail between the second and third sidewalls.

In some embodiments, an apparatus for mooring a boat may include one or more flanges at respective ends of the second and third sidewalls. The first and second sidewalls may extend from respective first ends at respective left and right ends of the first sidewall.

In some embodiments, a clamping fastener may coupled to a movable jaw of the first clamping structure and the second side wall. In some embodiments, the cleat may be coupled to the first of the plurality of sidewalls. In some embodiments, the cleat may be integrally formed with the first of the plurality of sidewalls. In some embodiments, the mount body may include a polymer or metal.

In some embodiments, an apparatus for mooring a boat may include a mount body including a first portion and a second portion. A hinge may be rotatably coupled to the first portion and the second portion. A cleat may extend from the first portion. A clamping structure comprising a movable jaw may be coupled to the first portion.

In some embodiments, the clamping structure includes a fixed jaw that may be formed of the second portion.

In some embodiments, a first flange may extend from the first portion and a second flange may extend from the second portion. The first flange and the second flange may be configured to abut one another and to form a channel between the first portion and the second portion.

In some embodiments, a clamping fastener may be coupled to a movable jaw of the first clamping structure and first portion. In some embodiments, the cleat may be coupled to the first portion. In some embodiments, the cleat may be integrally formed with the first portion. In some embodiments, the mount body may include a polymer or metal.

INCORPORATION BY REFERENCE

All patents, applications, and publications referred to and identified herein are hereby incorporated by reference in their entirety and shall be considered fully incorporated by reference even though referred to elsewhere in the application.

BRIEF DESCRIPTION OF THE DRAWINGS

A better understanding of the features, advantages and principles of the present disclosure will be obtained by reference to the following detailed description that sets forth illustrative embodiments, and the accompanying drawings of which.

DETAILED DESCRIPTION

The following detailed description provides a better understanding of the features and advantages of the inventions described in the present disclosure in accordance with the embodiments disclosed herein. Although the detailed description includes many specific embodiments, these are provided by way of example only and should not be construed as limiting the scope of the inventions disclosed herein.

Embodiments of the present disclosure provide improved methods and apparatus for mooring boats, such as tying boats to docks. The methods and apparatus disclosed herein are well suited for many types of boat mooring and can be incorporated into many prior systems and methods.

Figure 1:
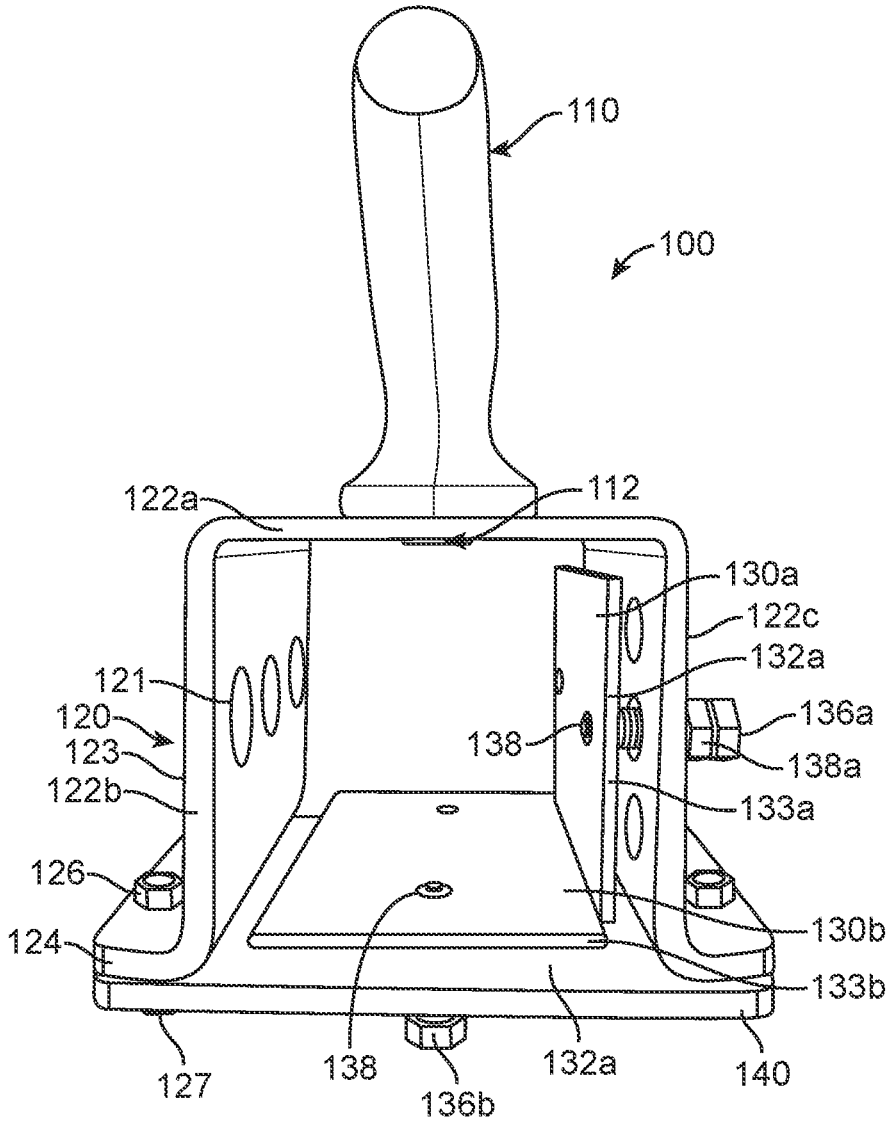
FIG. 1 depicts a side view of mooring clamp, in accordance with some embodiments.
Figure 2:
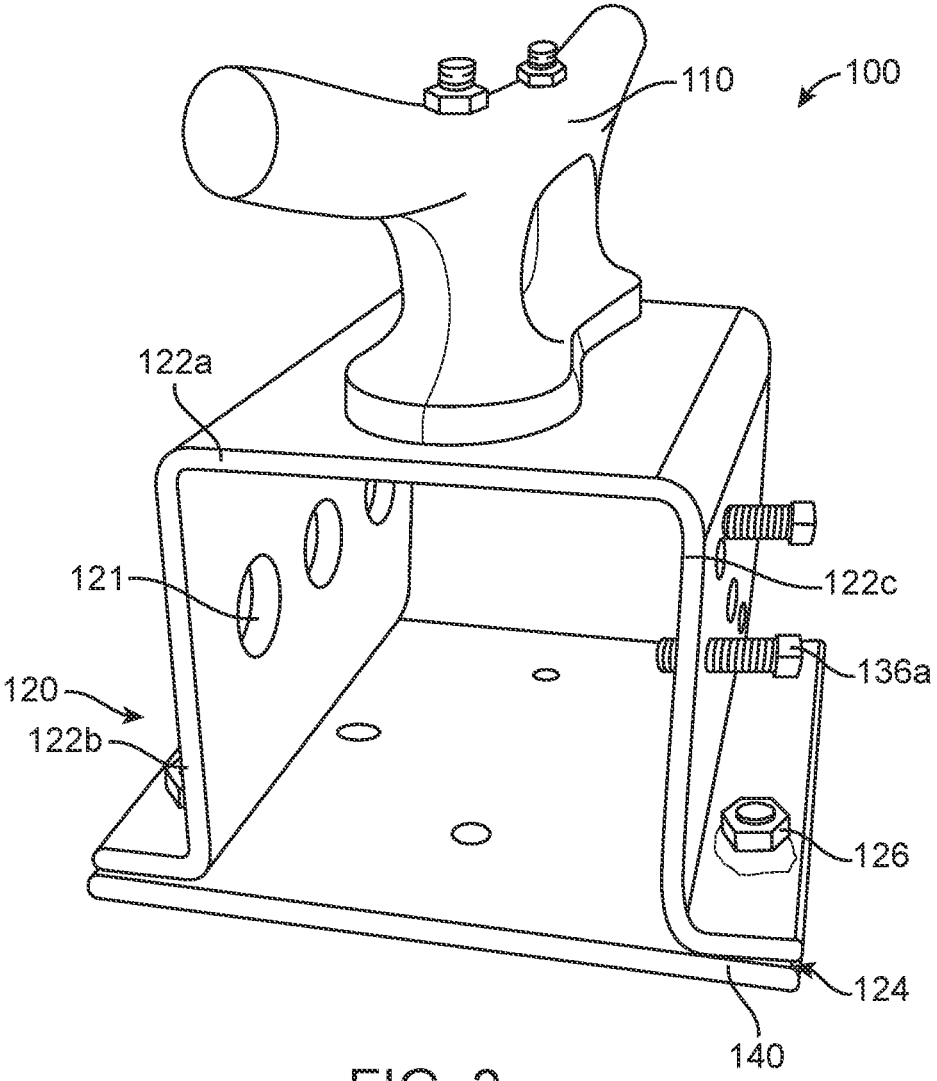
FIG. 2 depicts a side view of the mooring clamp of FIG. 1, in accordance with some embodiments.

With reference to FIGS. 1-4, a mooring apparatus 100 is shown in accordance with some embodiments disclosed herein. The mooring apparatus 100 is a portable mooring cleat that is configured to be removably coupled to mooring rails commonly found on docks at marinas and other locations on the water. The mooring apparatus 100 includes a cleat 110 and a mount 120. The cleat 110 is shown coupled to the top of the mount 120 using a fastener 112. The fastener may be a bolt, machine screw, or other fastener that couples the cleat 110 to the mount 120. As shown in FIG. 2, the fastener 112 may be a bolt that extends through an aperture in the mount 120 and a corresponding aperture in the cleat 110. The fastener may be secured by a nut.

In some embodiments the cleat 110 may be integrally formed with or into the mount 120. In some embodiments, a fastener such as a nut may be embedded within a sidewall, such as top sidewall 122A of the body 123 of the mount 120. In some embodiments, the top sidewall 122A may include a threaded aperture shaped to receive and secure the fastener 112. The cleat 110 and mount 120 may be formed via a casting or machine process and may be made from metal, such as stainless steel, galvanized steel, or other rust resistant metals. In some embodiments, the cleat 110 and mount 120 may be formed of a polymer, such as an injection molded nylon, or composite, such as a fiber reinforced plastic.

The mount 120 includes a body 123, a removable plate 140, and one or more clamps 130. The body 123 comprises a generally U-shaped or C-shaped channel formed from three sidewalls 122. The sidewalls 122 may be substantially planar, as shown in FIG. 1.

As shown in FIG. 1, a first sidewall, such as the top sidewall 122A, extends from a first end to a second end in a direction into the page of FIG. 1 and has a first side and a second side along the left and right sides of the sidewall 122A. The sidewall 122A includes a first surface that faces into the channel that is opposite a second surface that faces away from the channel. The cleat fastener 112 may be placed through an aperture in the sidewall 122A that extends from the first surface to the second surface. The first surface may be referred to as an interior facing surface and the second surface may be referred to as an exterior facing surface. The cleat 110 extends from the exterior facing surface of the sidewall 122A.

A second sidewall 122B extends from the left side of the sidewall 122A and is substantially perpendicular to the sidewall 122A. The sidewall 122B includes a first surface that faces into the channel that is opposite a second surface that faces away from the channel. Apertures 121 may be formed through the sidewall 122B. The apertures 121 may extend from the first surface to the second surface. The first surface may be referred to as an interior facing surface and the second service may be referred to as an exterior facing surface. The sidewall 122B extends from a first end where it joins the top sidewall 122A to a second end opposite the first end. A flange 124, discussed below, may be formed at the second end.

A third sidewall 122C extends from the right side of the sidewall 122A and is substantially perpendicular to the sidewall 122A. The sidewall 122C includes a first surface that faces into the channel that is opposite a second surface that faces away from the channel. Apertures may be formed through the sidewall 122B. The apertures may extend from the first surface to the second surface. The sidewall 122C extends from a first end where it joins the top sidewall 122A to a second end opposite the first end. A flange 124, discussed below, may be formed at the second end. The interior or inward facing surfaces and the exterior or outward facing surfaces of sidewall 122B in sidewall 122C may be parallel to each other.

The body 123 may also include one or more flanges 124. As shown in FIG. 1, a first flange 124 extends from an end of the sidewall 122B opposite the sidewall 122A. The flange 124 may extend from the external surface of the sidewall 122B in a direction perpendicular to the external surface of the sidewall 122B. The flange may extend along the length of the sidewall 122B. In some embodiments, the flange may not extend along the entire length of the sidewall 122B. For example, in some embodiments, two or more flanges 124 may extend from the sidewall 122B. For example, as shown in FIGS. 1-4, each flange may include two nuts for receiving a bolt. In some embodiments, a first flange may be located nearer the first end of the sidewall 122B and include a first nut 126 for receiving a bolt 127 and a second flange may be located nearer a second end of the sidewall 122B and may include a second nut 126 for receiving a second bolt 127. The flange 124 may have a mating surface configured to mate with a bottom plate 140, discussed below.

As shown in FIG. 1, a second flange 124 extends from an end of the sidewall 122C opposite the sidewall 122A. The flange 124 may extend from the external surface of the sidewall 122C in a direction perpendicular to the external surface of the sidewall 122C. The second flange may extend along the length of the sidewall 122C. In some embodiments, the flange may not extend along the entire length of the sidewall 122C. For example, in some embodiments, two or more second flanges 124 may extend from the sidewall 122C. For example, as shown in FIGS. 1-4, each flange may include two nuts for receiving a bolt. In some embodiments, a flange may be located nearer the first end of the sidewall 122C and include a first nut 126 for receiving a bolt 127 and a flange may be located nearer a second end of the sidewall 122C and may include a second nut 126 for receiving a second bolt 127. The second flange 124 may have a mating surface configured to mate with a bottom plate 140, discussed below. The mating surface of the first flange 124 and the mating surface of the second flange 124 may be coplanar or in the same plane with each other.

The mount 120 may also include a plate 140. The plate 140 closes the channel formed by the sidewalls 122A, 122B, 122C. Explained another way, the plate 140 closes the open end of the U-shaped or C-shaped channel formed by the sidewalls 122A, 122B, 122C. The bottom plate 140 has a width that spans the distance between the first flange 124 extending from sidewall 122B and the second flange 124 extending from sidewall 122C. The bottom plate 140 may form a fourth sidewall to enclose the channel. The plate 140 may include an inward facing surface and an outward facing surface, the inward facing surface facing the interior of the channel and the outward facing surface facing away from the channel. The one or more of the inward facing surface and the outward facing surface of the plate 140 may be parallel to the inward facing surface or outward facing surface of the sidewall 122A. The plate 140 may be referred to as a bottom plate when it is in the location shown in FIGS. 1-4.

In some embodiments, the plate 140 and the flange 124 may be located in other locations with respect to the mount 120 and the cleat 110. In the embodiment depicted in FIGS. 1-4, the channel is an upside-down U-shaped channel. However, in some embodiments, the channel may be a right side up U-shaped channel. In such embodiments, a sidewall may be a bottom sidewall extending between the lower edges of sidewall 122B and sidewall 122C. In such embodiments, flange 124 may be located at an upper end of sidewalls 122B, 122C the plate 140 may be a top plate.

In addition, the cleat 110 may be coupled to the top plate 140. In such an embodiment, the cleat 110 may be coupled to the top of the plate 140 using a fastener 112. The fastener may be a bolt, machine screw or other fastener that couples the cleat 110 to the mount 120. The fastener 112 may be a bolt that extends through an aperture in the plate 140 and a corresponding aperture in the cleat 110. The fastener may be secured by a nut. In some embodiments, the cleat 110 may be integrally formed with or in the plate 140. In some embodiments, a fastener, such as a nut, may be embedded within the plate 140. In some embodiments plate 140 may include a threaded aperture shaped to receive and secure the fastener 112. In some embodiments, the cleat 110 may be formed of a polymer, such as an injection molded nylon with the bottom plate.

In addition, in an embodiment wherein the plate 140 is located at a top of the mount 120, the flanges 124 may be similarly located at a top of the sidewalls 122B, 122C. In such an embodiment, the flanges 124 may extend from upper ends of the sidewalls 122B, 122C. The flanges 124 may extend from the external surfaces of the sidewalls 122B, 122C in a direction perpendicular to the external surface of the sidewalls 122B, 122C. Similar to the flange described above, when the flanges are located at an upper end of the sidewalls 122B, 122C, the flanges may extend along the length of the sidewalls 122B, 122C. In some embodiments, the flanges may not extend along the entire length of the sidewalls 122B, 122C. For example, in some embodiments, two or more second flanges 124 may extend from each of the sidewalls 122B, 122C. For example, a flange may be located nearer the first end of the sidewalls 122B, 122C and include a first nut 126 for receiving a bolt 127 and a flange may be located nearer a second end of the sidewalls 122B, 122C and may include a second nut 126 for receiving a second bolt 127. The flanges 124 may have mating surfaces configured to mate with a plate 140. The mating surfaces may be coplanar or in the same plane with each other.

In some embodiments, the removable plate 140 may be a side plate located on the left or right side of the body 123 of the mount 120. In such embodiments, the channel may be a right facing or left facing C-shaped channel with an opening of the channel facing the right or left side of the mount shown in FIG. 1. In such embodiments, one or more flanges are located at a left or right side of the mount 120.

In such an embodiment, a first flange 124 may extend from a right end of a top sidewall 122A and a second flange 124 may extend from a right end of a bottom sidewall. The flanges 124 may extend from the external surfaces of the sidewalls in a direction perpendicular to the external surface of the sidewalls. Similar to the flanges described above, when the flanges are located at a right end of the sidewalls 122, the flanges may extend along the length of the sidewalls 122. In some embodiments, the flanges may not extend along the entire length of the sidewalls 122B, 122C. For example, in some embodiments, two or more second flanges 124 may extend from each of the sidewalls 122. For example, a flange may be located nearer the first end of the sidewalls 122 and include a first nut 126 for receiving a bolt 127 and a flange may be located nearer a second end of the sidewalls 122 and may include a second nut 126 for receiving a second bolt 127. The flanges 124 may have mating surfaces configured to mate with a plate 140. The mating surfaces may be coplanar or in the same plane with each other. When the plate 140 is located on a side of the mount 120 then the mating surfaces may be in a vertical plane.

The mount 120 may include one or more clamps 130 for fixing the mooring apparatus to a dock rail. A clamp 130, such as the side clamp 130A, may include a movable jaw portion, such as clamping plate 132A and a fixed jaw portion which may be opposite a sidewall, such as sidewall 122B. The clamping structure 130A functions by moving the movable jaw portion 132A towards the sidewall 122B when the mooring apparatus 100 is placed on a dock rail. By moving the movable jaw 132A towards the sidewall 122B, the clamp 130A applies compression forces to the dock rail. These compression forces hold the mooring apparatus in a desired location to aid in resisting movement of the mooring apparatus.

The movable jaw 132A includes a clamping plate 133A that is movably coupled to a sidewall, such as sidewall 122C by screw, bolt, or other clamping fastener 136A. The clamping fastener 136A is received by the sidewall 122C through a threaded aperture that extends through the sidewall 122C. In some embodiments, the threaded aperture may be provided, at least in part, by a nut welded to or embedded within the sidewall 122C. The clamping fastener 136A may include a head at one end and a threaded portion extending from the head. An end of the threaded portion may be configured to receive a rotational coupling that allows the clamping fastener 136A to be rotationally coupled to the plate 133A. In this way, rotating the clamping fastener 136A causes the threads of the clamping fastener 136A to engage with threads in the sidewall 122C and to move or translate the clamping fastener and the clamping plate 133A with respect to the sidewalls 122B, 122C while allowing the end of the clamping fastener 136A to rotate with respect to the clamping plate 133A. In some embodiments, a locking fastener 138A may be used to prevent undesired rotation of the clamping fastener 136A. The locking fastener 138A may be a nut that when rotated towards the sidewall 122C may apply a force to the threaded shaft of the clamping fastener 136A and aid in preventing undesirable rotation of the clamping fastener 136A.

In some embodiments, the plate 132A of the moveable jaw may be coupled to the clamping fastener 136A via a rotatable coupling. In some embodiments, the plate 132A may not be coupled to the moveable jaw. For example, during use, the plate 132A may be inserted between the clamping fastener 136A and a rail. The clamping fastener may then clamp the plate 132A against the rail to couple the mooring apparatus to the rail.

As shown in FIGS. 1-4, a first or side clamping structure 130A may provide clamping in a horizontal direction while a second or vertical clamping structure 130B may provide clamping in a vertical direction.

The vertical clamp 130B, may include a movable jaw portion, such as clamping plate 132B and a fixed jaw portion which may be opposite a sidewall, such as sidewall 122A. The clamping structure 130B functions by moving the movable jaw portion 132B towards the sidewall 122A when the mooring apparatus 100 is placed on a dock rail. By moving the movable jaw 132B a towards the sidewall 122A the clamp 130B applies compression forces to the dock rail. These compression forces hold the mooring apparatus in a desired location in aid in resisting movement of the mooring apparatus.

The movable jaw 132B includes a clamping plate 133B that is movably coupled to the plate 140 by screw, bolt, or other clamping fastener 136B. The clamping fastener 136B is received by the plate 140 through a threaded aperture that extends through the plate 140. In some embodiments, the threaded aperture may be provided, at least in part, by a nut welded to or embedded within the plate 140. The clamping fastener 136B may include a head at one end and a threaded portion extending from the head. An end of the threaded portion may be configured to receive a rotational coupling that allows the clamping fastener 136B to be rotationally coupled to the plate 133B. In this way, rotating the clamping fastener 136B causes the threads of the clamping fastener 136B to engage with threads in the plate 140 and to move or translate the clamping fastener and the clamping plate 133B with respect to the plate 140 and the sidewall 122A while allowing the end of the clamping fastener 136B to rotate with respect to the clamping plate 133B. In some embodiments, a locking fastener 138B may be used to prevent undesired rotation of the clamping fastener 136B. The locking fastener 138B may be a nut that when rotated towards the plate 140 may apply a force to the threaded shaft of the clamping fastener 136B and aid in preventing undesirable rotation of the clamping fastener 136B.

In some embodiments, the plate 140 may act as the clamping structure and movable jaw. In the embodiment shown in FIGS. 1-4, the vertical depth and horizontal width of the channel is greater than the height and width of a dock rail to which the mooring apparatus 100 would the attached. When using the plate 140 as the clamping structure and movable jaw for a vertical clamp, the vertical depth of the channel of the mooring apparatus 100 may be less than the vertical height of the dock rail to which the mooring apparatus 100 would be attached. In such embodiments, the bolts 127 may act as the clamping fastener and rotation of the bolts 127 may cause movement of the plate 140 with respect to the dock rail and tightening of the bolts 140 because a clamping force between the sidewall 122A and the plate 140.

When using the plate 140 as the clamping structure and movable jaw for a horizontal clamp, the horizontal width of the channel of the mooring apparatus 100 may be less than the horizontal width of the dock rail to which the mooring apparatus 100 would be attached. In such embodiments, the bolts 127 may act as the clamping fastener and rotation of the bolts 127 may cause movement of the plate 140 with respect to the dock rail and tightening of the bolts 127 because a clamping force between the sidewall 122B and the plate 140. In some embodiments, the channel is shaped to receive a 4"×4" rail. In some embodiments, the channel is about 4"×4", but may accept a 4"×6" rail. In such embodiments, the bolts 127 may be at least 2 inches long in order to accommodate a larger rail within in the 4"×4" channel.

In some embodiments, the mooring apparatus 100 may include one, two, three, or four clamping structures. In some embodiments, one or more of the clamping plates in the sidewalls may have a smooth or textured surface. A textured surface may provide greater engagement between the mount 120 and the dock rail.

Referring now to FIG. 2 a side view of the mooring clamp of FIG. 1 is shown without a clamping plate or locking nut. In some embodiments, a clamping fastener, such as clamping fastener 136A may be used without the clamping plate. In such an embodiment the clamping fastener 136A is driven through the sidewall 122 and into the dock rail.

Figure 3:
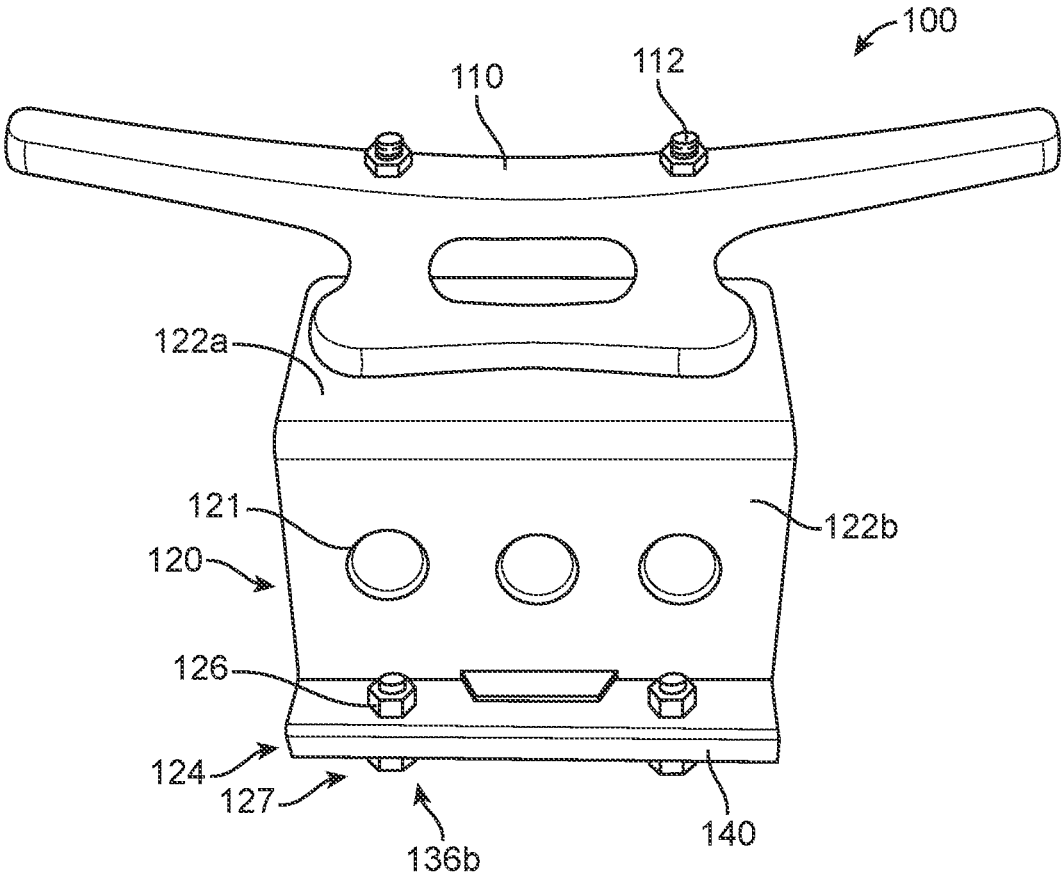
FIG. 3 depicts a front view of the mooring clamp of FIG. 1, in accordance with some embodiments.

Referring now to FIG. 3 a front view of the mooring clamp of FIG. 1 is shown. While the sidewall 122B is depicted as having three apertures 121, the sidewalls 122 may have greater or fewer apertures 121. The apertures may be weight reducing apertures wherein material is removed from the sidewalls in order to reduce the weight of the mooring apparatus 100. In some embodiments, such as when the mount 120 is formed using an injection molding process the apertures 121 may be formed during the injection molding process rather than through a material removal process.

Figure 4:
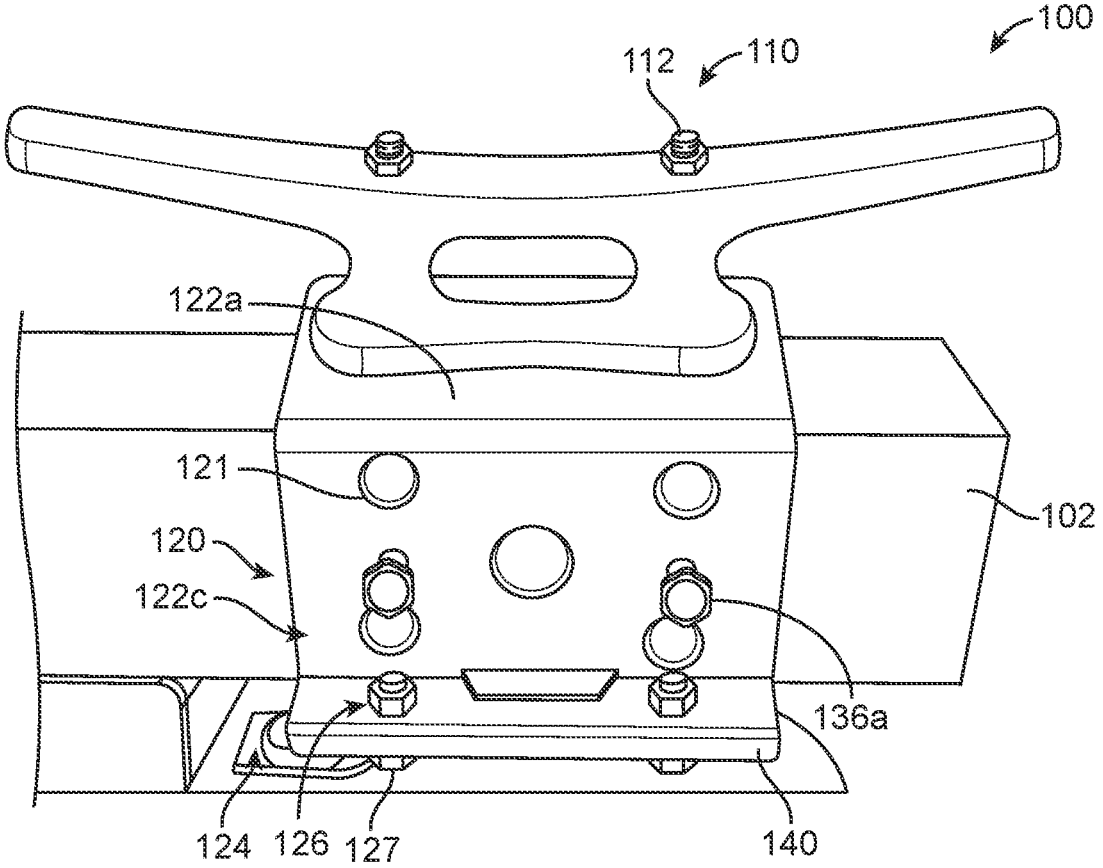
FIG. 4 depicts a front view of the mooring clamp of FIG. 1 attached to a dock tie down rail, in accordance with some embodiments.

Referring now to FIG. 4 a front view of the mooring clamp of FIG. 1 is shown with the mooring clamp 100 affixed to a dock rail 102. The process of affixing the mooring apparatus 100 to a dock rail may begin by placing the mount 120 over the dock rail 102 such that the dock rail is within the channel formed by the mount 120. The plate 140 may be attached to the mount 120 by bolting the plate 140 to the flange is 124 of the mount 120, for example. The mount 120 may then be clamped to the dock rail 102 by moving one or more movable jaws of a clamping structure to provide a clamping force to hold the mooring apparatus 100 at a desired location on the rail 102.

Figure 5:
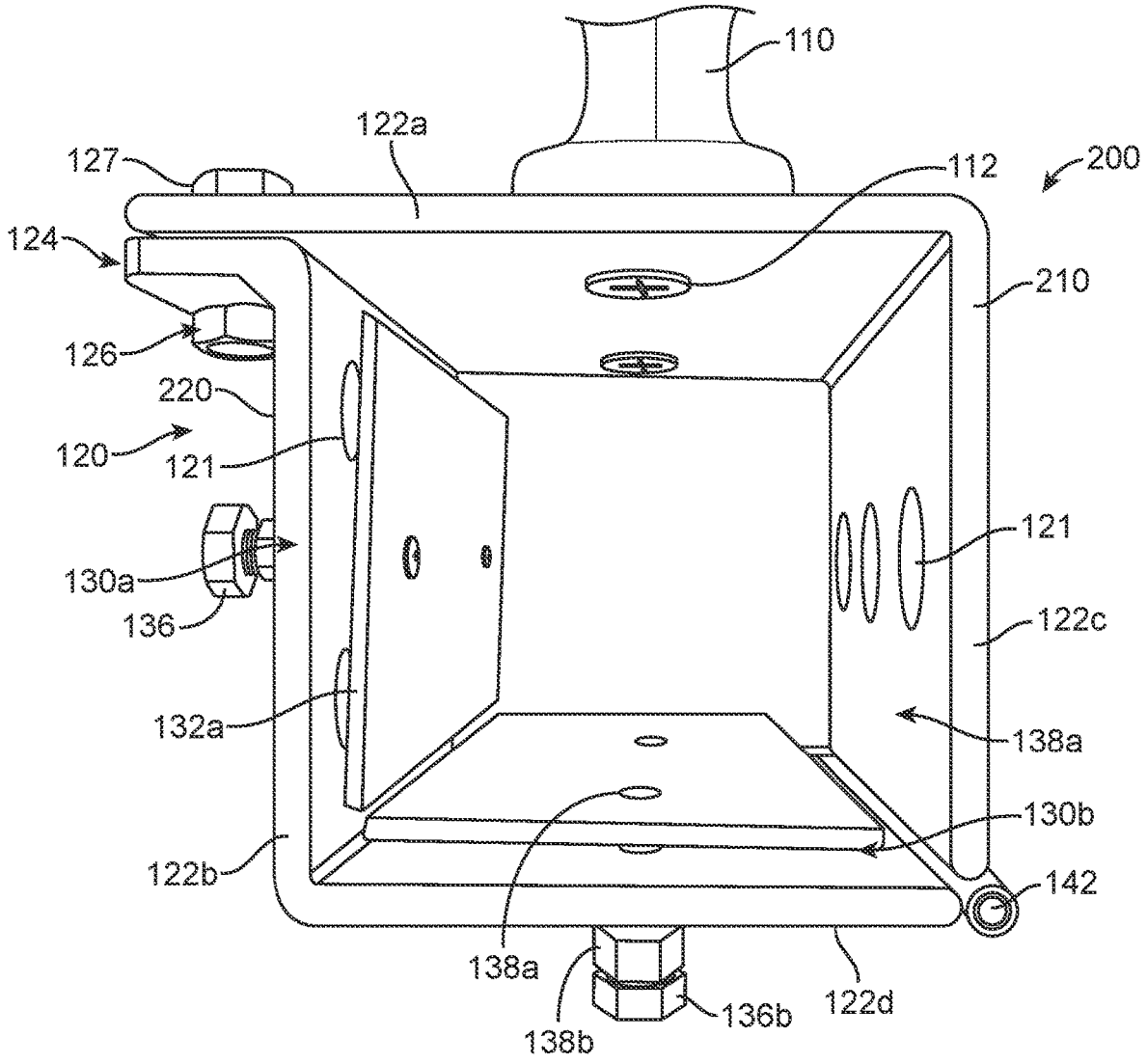
FIG. 5 depicts a side view of a hinged mooring clamp, in accordance with some embodiments.
Figure 6:
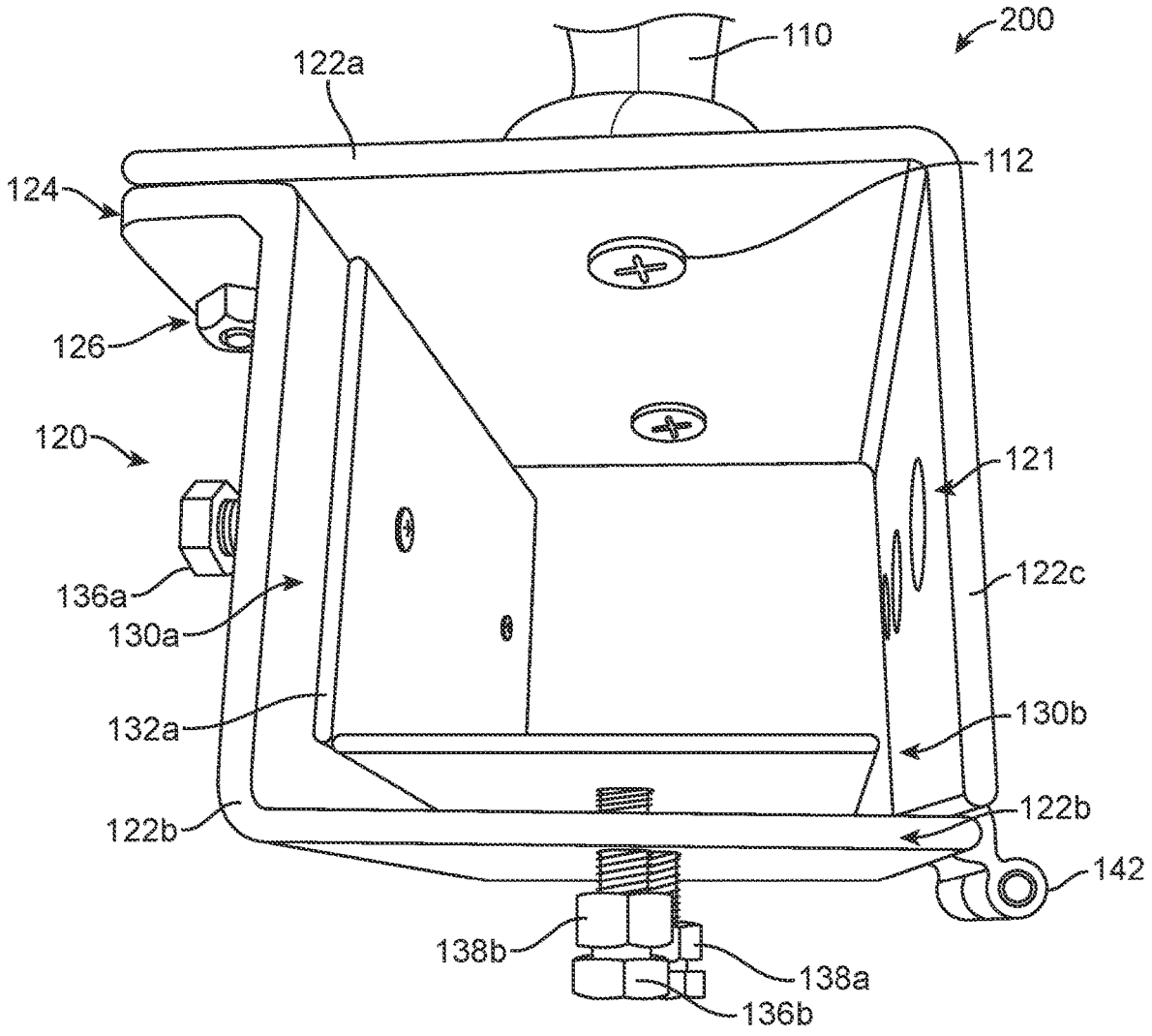
FIG. 6 depicts a side bottom view of the hinged mooring clamp of FIG. 5, in accordance with some embodiments.
Figure 7:
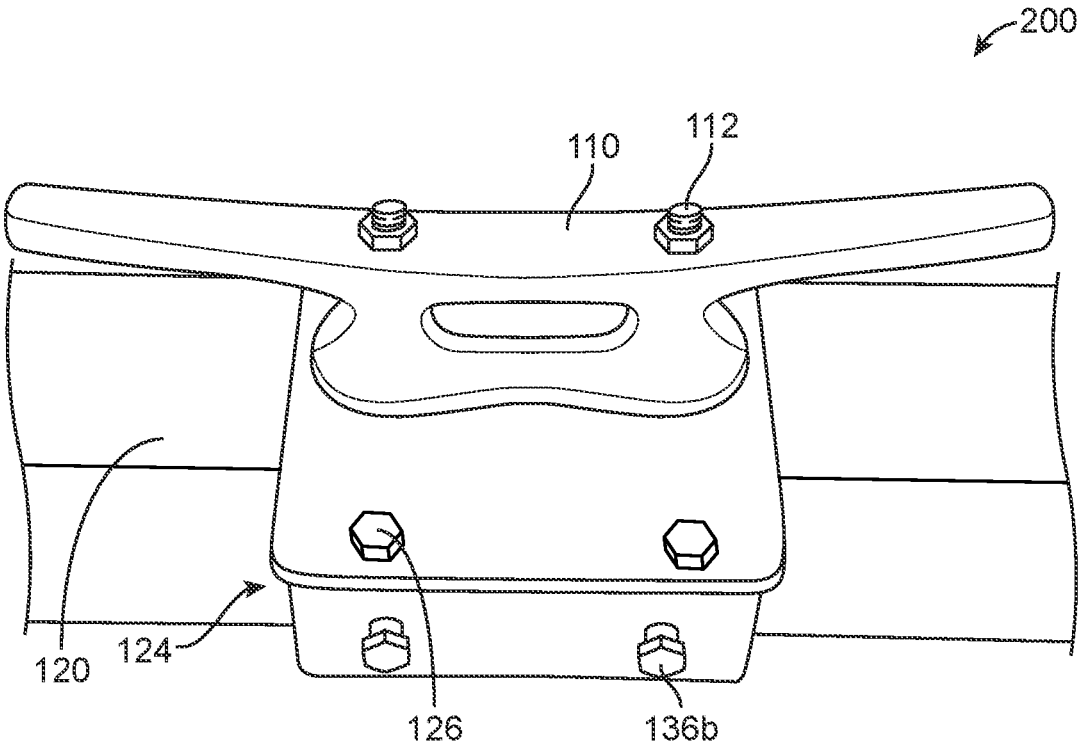
FIG. 7 depicts a top front view of the hinged mooring clamp of FIG. 5, in accordance with some embodiments.

With reference to FIGS. 5-7, a hinged mooring clamp 200 is shown.

With reference to FIGS. 5-7, a mooring apparatus 200 is shown in accordance with some embodiments disclosed herein. The mooring apparatus 200 is a portable mooring cleat that is removably coupled to mooring rails commonly found on docks at marinas and other locations on the water. The mooring apparatus 200 includes a cleat 110 and a mount 120. The cleat 110 is shown coupled to the top of the mount 120 using a fastener 112. The fastener may be a bolt or machine screw or other fastener that couples the cleat 110 to the mount 120. The fastener 112 may be a bolt or machine screw that extends through an aperture in the mount 120 and a corresponding aperture in the cleat 110. The fastener may be secured by a nut. In some embodiments, the cleat 110 may be integrally formed with or into the mount 120. In some embodiments a fastener such as a nut may be embedded within a sidewall, such as top sidewall 122A, of the body 123 of the mount 120. In some embodiments the top sidewall 122A may include a threaded aperture shaped to receive and secure the fastener 112. The cleat 110 and mount 120 may be formed via a casting or machine process and may be made from metal, such as stainless steel, galvanized steel, or other rust resistant metals or carbon steel. In some embodiments, the cleat 110 and mount 120 may be formed of a polymer, such as an injection molded nylon.

The mount 120 includes a body 123 includes a first portion 210 that may be referred to as a fixed or cleat portion and a second portion 220 that may be referred to as a moveable or hinged portion, and one or more clamps 130. Although referred to as fixed and moveable, the terms are meant for reference and ease of description and are not meant to mean that the fixed portion is not moveable. Both the fixed portion and the moveable portion are moveable relative to each other. The body 123 comprises two generally L-shaped portions formed from one or more sidewalls 122. The sidewalls 122 may be substantially planar. As shown in FIG. 5, a first sidewall such as the top sidewall 122A extends from a first end to a second end in a direction into the page of FIG. 5 and has a first side and a second side along the left and right sides of the sidewall 122A. The sidewall 122A includes a first surface that faces into the channel that is opposite a second surface that faces away from the channel. The cleat fastener 112 is placed through an aperture in the sidewall 122A that extends from the first surface to the second surface. The first surface may be referred to as an interior facing surface and the second service may be referred to as an exterior facing surface. The cleat 110 extends from the exterior facing surface of the sidewall 122A. A flange 124, may be formed at the left side of the sidewall 122A.

A second sidewall 122C extends from the right side of the sidewall 122A and is substantially perpendicular to the sidewall 122A. The sidewall 122C includes a first surface that faces into the channel that is opposite a second surface that faces away from the channel. Apertures may be formed through the sidewall 122B. The apertures may extend from the first surface to the second surface. The first surface may be referred to as an interior facing surface and the second service may be referred to as an exterior facing surface. The sidewall 122C extends from a first end where it joins the top sidewall 122A to a second end opposite the first end. A hinge 142 is located at the second end of the sidewall 122A.

The first sidewalls 122A and the second sidewall 122C form a first or fixed portion of the mount 120. A third sidewall 122B and fourth sidewall 122D form a second portion.

The third sidewall 122B is releasably couplable to the left side of the sidewall 122A and is substantially perpendicular to the sidewall 122A. The sidewall 122B includes a first surface that faces into the channel that is opposite a second surface that faces away from the channel. Apertures 121 may be formed through the sidewall 122B. The apertures 121 may extend from the first surface to the second surface. The first surface may be referred to as an interior facing surface and the second service may be referred to as an exterior facing surface. The sidewall 122B extends from a first end where it is releasable couplable to the top sidewall 122A to a second end, opposite the first end. A flange 124, discussed below, may be formed at the first end.

A fourth sidewall 122D extends from the second end of the sidewall 122B and is substantially perpendicular to the sidewall 122B. The sidewall 122D includes a first surface that faces into the channel that is opposite a second surface that faces away from the channel. Apertures may be formed through the sidewall 122B. The apertures may extend from the first surface to the second surface. The first surface may be referred to as an interior facing surface and the second service may be referred to as an exterior facing surface. The sidewall 122D extends from a first end where it joins the sidewall 122B to a second end opposite the first end. A hinge 142 is located at the second end of the sidewall 122B.

The hinge 142 joins the first portion 210 to the second portion 220 such that the first portion 210 and the second portion 220 are moveable relative to each other about the axis of the hinge.

The body 123 may also include one or more flanges 124. As shown in FIG. 5, a first flange 124 extends from a first end of the sidewall 122B. The flange 124 may extend from the external surface of the sidewall 122B in a direction perpendicular to the external surface of the sidewall 122B. The flange may extend along the length of the sidewall 122B. In some embodiments, the flange may not extend along the entire length of the sidewall 122B. For example, in some embodiments, two or more flanges 124 may extend from the sidewall 122B. In some embodiments, a first flange may be located nearer the first end of the sidewall 122B and include a first nut 126 for receiving a bolt 127 and a second flange may be located nearer a second end of the sidewall 122B and may include a second nut 126 for receiving a second bolt 127. The flange 124 may have a mating surface configured to mate with a bottom plate 140, discussed below.

As shown in FIG. 5, a second flange 124 extends from a left end of the sidewall 122A. The flange 124 may extend the external surface of the sidewall 122C in a direction perpendicular to the external surface of the sidewall 122B. The second flange may extend along the length of the sidewall 122A. In some embodiments, the flange may not extend along the entire length of the sidewall 122A. For example, in some embodiments, two or more second flanges 124 may extend from the sidewall 122A. In some embodiments, a flange may be located nearer the first end of the sidewall 122A and include a first nut 126 for receiving a bolt 127 and a flange may be located nearer a second end of the sidewall 122A and may include a second nut 126 for receiving a second bolt 127. The second flange 124 may have a mating surface configured to mate with a corresponding mating surface of the flange 124 that extends from the third sidewall 122B. The mating surface of the first flange 124 and the mating surface of the second flange 124 may be coplanar or in the same plane with each other.

In some embodiments, a hinge 124 may join the first sidewall with the second sidewall. In such embodiments, the first portion may include the first sidewall while the second portion includes the second third and fourth sidewalls. In some embodiments, the hinge may join the fourth sidewall with the third sidewall. In such embodiments, the first portion may include the first, second, and fourth sidewalls and the second portion may include the third sidewall. In some embodiments a first hinge 124 may join the first and second sidewalls, a second hinge may join the second and fourth sidewalls, and third hinge may join the fourth and third sidewalls. In such embodiments, all four sidewalls are movable roof relative to each of the other sidewalls.

The mount 120 may include one or more clamps 130 for fixing the mooring apparatus to a dock rail. A clamp 130, such as the side clamp 130A, may include a movable jaw portion, such as clamping plate 132A and a fixed jaw portion which may be opposite a sidewall, such as sidewall 122C. The clamping structure 130A functions by moving the movable jaw portion 132A towards the sidewall 122C when the mooring apparatus 200 is placed on a dock rail. By moving the movable jaw 132A towards the sidewall 122C the clamp 130A applies compression forces to the dock rail. These compression forces hold the mooring apparatus in a desired location in aid in resisting movement of the mooring apparatus.

The movable jaw 132A includes a clamping plate 133A that is movably coupled to a sidewall, such as sidewall 122B by screw, bolt, or other clamping fastener 136A. The clamping fastener 136A is received by the sidewall 122B through a threaded aperture that extends through the sidewall 122B. In some embodiments, the threaded aperture may be provided, at least in part, by a nut welded to or embedded within the sidewall 122B. The clamping fastener 136A may include a head at one end and a threaded portion extending from the head. An end of the threaded portion may be configured to receive a rotational coupling that allows the clamping fastener 136A to be rotationally coupled to the plate 133A. In this way, rotating the clamping fastener 136A causes the threads of the clamping fastener 136A to engage with threads in the sidewall 122B and to move or translate the clamping fastener and the clamping plate 133A with respect to the sidewalls 122B, 122C while allowing the end of the clamping fastener 136A to rotate with respect to the clamping plate 133A. In some embodiments, a locking fastener 138A may be used to prevent undesired rotation of the clamping fastener 136A. The locking fastener 138A may be a nut that when rotated towards the sidewall 122B may apply a force to the threaded shaft of the clamping fastener 136A and aid in preventing undesirable rotation of the clamping fastener 136A.

As shown in FIGS. 5-7, a first or side clamping structure 130A may provide clamping in a horizontal direction while a second or vertical clamping structure 130B may provide clamping in a vertical direction.

The vertical clamp 130B, may include a movable jaw portion, such as clamping plate 132B and a fixed jaw portion which may be opposite a sidewall, such as sidewall 122A. The clamping structure 130B functions by moving the movable jaw portion 132B towards the sidewall 122A when the mooring apparatus 200 is placed on a dock rail. By moving the movable jaw 132B a towards the sidewall 122A the clamp 130B applies compression forces to the dock rail. These compression forces hold the mooring apparatus in a desired location in aid in resisting movement of the mooring apparatus.

The movable jaw 132B includes a clamping plate 133B that is movably coupled to the sidewall 122D by screw, bolt, or other clamping fastener 136B. The clamping fastener 136B is received by the sidewall 122D through a threaded aperture that extends through the sidewall 122D. In some embodiments, the threaded aperture may be provided, at least in part, by a nut welded to or embedded within the sidewall 122D. The clamping fastener 136B may include a head at one end and a threaded portion extending from the head. An end of the threaded portion may be configured to receive a rotational coupling that allows the clamping fastener 136B to be rotationally coupled to the plate 133B. In this way, rotating the clamping fastener 136B causes the threads of the clamping fastener 136B to engage with threads in the sidewall 122D and to move or translate the clamping fastener and the clamping plate 133B with respect to the sidewall 122D and the sidewall 122A while allowing the end of the clamping fastener 136B to rotate with respect to the clamping plate 133B. In some embodiments, a locking fastener 138B may be used to prevent undesired rotation of the clamping fastener 136B. The locking fastener 138B may be a nut that when rotated towards the sidewall 122D may apply a force to the threaded shaft of the clamping fastener 136B and aid in preventing undesirable rotation of the clamping fastener 136B.

In some embodiments, the mooring apparatus 200 may include one, two, three, or four clamping structures. In some embodiments, one or more of the clamping plates in the sidewalls may have a smooth or textured surface. A textured surface may provide greater engagement between the mount 120 and the dock rail.

Referring now to FIG. 6, a side bottom view of the hinged mooring clamp of FIG. 5 is shown. Here, the locking fastener 138B is shown disengaged from the sidewall 122D to allow the clamping fastener 136B to be rotated and to cause the plate of the bottom clamping structure 130B to move.

Referring now to FIG. 7, a top front view of the hinged mooring clamp of FIG. 5 is shown with the mooring clamp 200 affixed to a dock rail 102. The process of affixing the mooring apparatus 200 to a dock rail may begin by placing the first portion 210 the mount 120 on the dock rail 102. The second portion then be rotated relative to the first portion about the axis of the hinge until the flange of the first portion and the flange of the second portion about one another. The first portion and the second portion may be coupled to each other by bolting the flange of the first portion to the flange of the second portion. The mount 120 may then be clamped to the dock rail 102 by moving one or more movable jaws of a clamping structure to provide a clamping force to hold the mooring apparatus 100 at a desired location on the rail 102.

Figure 8C:
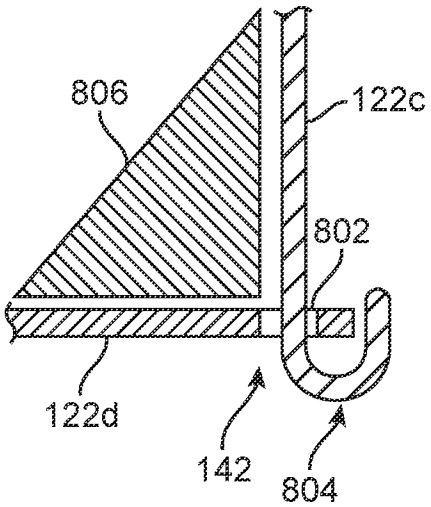
FIGS. 8A, 8B, and 8C depict a hinge for a mooring clamp, in accordance with some embodiments.
Figure 8B:
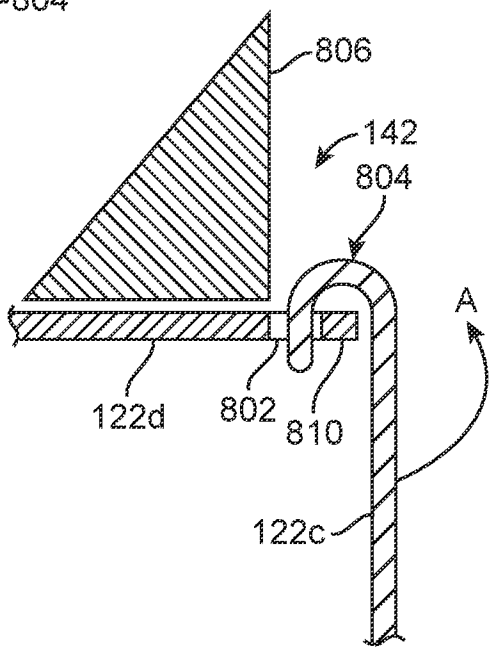
Figure 8A:
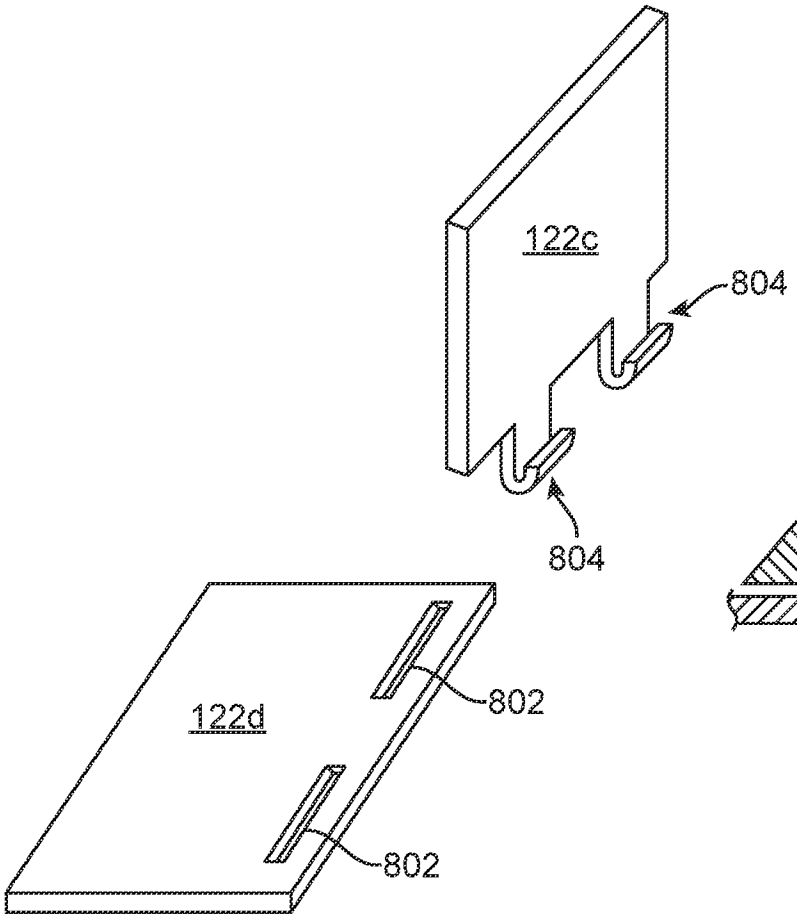

Referring now to FIGS. 8A, 8B, and 8C, an embodiment of a hinge 142. The hinge depicted is separable hinge, such as a two-part hinge. The hinge 142 may include apertures or slots formed in a first sidewall 122*d* and a hook, such as j-hook extending from a second sidewall 122*c*. Although depicted as sidewalls 122*c* and 122*d*, the sidewalls may be any adjacent sidewalls. The slots 802 are shaped to receive the ends of the hook 804, such as shown in FIG. 8B. To assemble the hinge during use, a first portion of the mount is abutted against a rail 806. Then the ends of the j-hooks 804 are inserted into the slots 802 with the sidewall 122*c* in a first orientation. After insertion, the sidewall 122*c* is rotated as depicted by arrow A, until the flanges, such as flanges 124 meet, see e.g., FIG. 5, and the mount closes around the rail 806.

In some embodiment, a dimension, such as a length, of a portion 810 extending from an edge of the aperture 802 to the end of the sidewall 122*d* is smaller than a width of the j-hook extending from an end of the j-hook to the sidewall.

A person of ordinary skill in the art will recognize that any process or method disclosed herein can be modified in many ways. The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed.

The various exemplary methods described and/or illustrated herein may also omit one or more of the steps described or illustrated herein or comprise additional steps in addition to those disclosed. Further, a step of any method as disclosed herein can be combined with any one or more steps of any other method as disclosed herein.

The processes as described herein can be configured to perform one or more steps of any method disclosed herein. Alternatively or in combination, the processes can be configured to combine one or more steps of one or more methods as disclosed herein.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and shall have the same meaning as the word "comprising.

The It will be understood that although the terms "first," "second," "third", etc. may be used herein to describe various layers, elements, components, regions or sections without referring to any particular order or sequence of events. These terms are merely used to distinguish one layer, element, component, region or section from another layer, element, component, region or section. A first layer, element, component, region or section as described herein could be referred to as a second layer, element, component, region or section without departing from the teachings of the present disclosure.

As used herein, the term "or" is used inclusively to refer items in the alternative and in combination.

As used herein, characters such as numerals refer to like elements.

Embodiments of the present disclosure have been shown and described as set forth herein and are provided by way of example only. One of ordinary skill in the art will recognize numerous adaptations, changes, variations and substitutions without departing from the scope of the present disclosure. Several alternatives and combinations of the embodiments disclosed herein may be utilized without departing from the scope of the present disclosure and the inventions disclosed herein. Therefore, the scope of the presently disclosed inventions shall be defined solely by the scope of the appended claims and the equivalents thereof.

What is claimed is:

1. An apparatus for mooring a boat comprising:
- a mount body including a plurality of sidewalls forming a channel;
- a cleat extending from a first of the plurality of sidewalls;
- a plate removably coupled to the mount body; and
- a clamping structure comprising a movable jaw coupled to a second of the plurality of sidewalls.

2. The apparatus of claim 1, wherein the clamping structure further comprises a fixed jaw formed of a third sidewall, the movable jaw being movably coupled to the second of the plurality of sidewalls and configured to apply clamping forces to a dock rail between the second and third sidewalls.

3. The apparatus of claim 1, further comprising:
- one or more flanges at respective ends of the second and third sidewalls.

4. The apparatus of claim 3, wherein the first and second sidewalls extend from respective first ends at respective left and right ends of the first sidewall.

5. The apparatus of claim 1, further comprising a clamping fastener coupled to a movable jaw of the first clamping structure and the second side wall.

6. The apparatus of claim 1, wherein the cleat is coupled to the first of the plurality of sidewalls.

7. The apparatus of claim 1, wherein the cleat is integrally formed with the first of the plurality of sidewalls.

8. The apparatus of claim 1, wherein the mount body comprises a polymer or metal.

9. The apparatus of claim 3, wherein the second and third sidewalls are coupleable to each other.

10. The apparatus of claim 9, wherein the second and third sidewalls are coupleable to each other via the one or more flanges.

11. An apparatus for mooring a boat comprising:
- a mount body including a first portion and a second portion;
- a hinge that rotatably couples the first portion and the second portion
- a cleat extending from the first portion; and
- a clamping structure comprising a movable jaw coupled to the first portion.

12. The apparatus of claim 11, wherein the clamping structure further comprises a fixed jaw formed of the second portion.

13. The apparatus of claim 11, further comprising:
- a first flange extending from the first portion; and
- a second flange extending from the second portion, wherein the first flange and the second flange are configured to abut one another and to form a channel between the first portion and the second portion.

14. The apparatus of claim 11, further comprising a clamping fastener coupled to a movable jaw of the first clamping structure and first portion.

15. The apparatus of claim 11, wherein the cleat is coupled to the first portion.

16. The apparatus of claim 11, wherein the cleat is integrally formed with the first portion.

17. The apparatus of claim 11, wherein the mount body comprises a polymer or metal.

18. The apparatus of claim 11, wherein the hinge is a separable hinge.

19. The apparatus of claim 18, wherein the hinge includes an aperture formed in the first portion and a j-hook formed in the second portion.

20. The apparatus of claim 19, wherein the aperture is shaped to accept the j-hook therein.

* * * * *